United States Patent [19]

Lebedev

[11] Patent Number: 4,871,212

[45] Date of Patent: Oct. 3, 1989

[54] DEVICE FOR BUILDING UP DIRECTIONAL FORCE

[75] Inventor: Jury A. Lebedev, Gorno-Altaisk, U.S.S.R.

[73] Assignee: Gorno-Altaisky Gosudarstvenny Pedagogichesky Institut, Gorno-Altaisk, U.S.S.R.

[21] Appl. No.: 271,950

[22] Filed: Sep. 16, 1988

[30] Foreign Application Priority Data

Jan. 23, 1987 [WO] PCT Int'l Appl. ..... PCT/SU87/00008

[51] Int. Cl.[4] ..... E21C 37/06; E21C 37/04

[52] U.S. Cl. ..... 299/21; 299/23

[58] Field of Search ..... 299/21, 23; 166/187, 166/212, 217; 269/48.1; 279/2 A; 29/113 R; 72/393

[56] References Cited

U.S. PATENT DOCUMENTS

| | | | |
|---|---|---|---|
| 3,401,946 | 9/1968 | Malone | 299/21 X |
| 4,657,306 | 4/1987 | Koopmans et al. | 299/21 |
| 4,690,460 | 9/1987 | Lebedev | 299/21 |

FOREIGN PATENT DOCUMENTS

| | | |
|---|---|---|
| 1033819 | 8/1983 | U.S.S.R. . |
| 1040147 | 9/1983 | U.S.S.R. . |
| | | Pat. No. 4,679,978. |
| 1218105 | 3/1986 | U.S.S.R. . |

*Primary Examiner*—Stephen J. Novosad

*Attorney, Agent, or Firm*—McAulay Fisher Nissen & Goldberg

[57] ABSTRACT

A device for building up directional force comprises an even number of tubular vessels (1) made of elastic material and adapted for communicating with a pressure fluid medium source, and a rigid rectilinear pivot (8) with flat bevels (19) which is positioned between the tubular vessels (1) so that the tubular vessels (1) are located symmetrically with respect to the geometrical axis (9) of said pivot (8). Provision is made for puncheons (10) adjoining the outside surface of the tubular vessel (1) and positioned diametrically opposite relative to the axis (9) of the pivot (8), with their inside surfaces (12) facing the surfaces (20) of the pivot (8), which adjoin the outside surfaces of the tubular vessels (1). Wedge-shaped inserts (14) are located diametrically opposite with respect to the axes (15) of the tubular vessels (1) and have surfaces (16) adjoining the outside surfaces of the tubular vessels (1) which are out of contact with the puncheon (10) and the pivot (8) and lateral surfaces (17, 18) adjoining the flat bevels (13) of the puncheons (10) and the flat bevels (19) of the pivot (8).

3 Claims, 3 Drawing Sheets

DEVICE FOR BUILDING UP DIRECTIONAL FORCE

TECHNICAL FIELD

The present invention relates to mining engineering, and, more particularly, it relates to a device for building up directional force.

PRIOR ART

There is known a device for demolishing solid structures which is in fact a device for building up directional force (SU, A, 1,033,819), comprising a tubular vessel made of some elastic material designed for communicating with a pressure fluid medium source.

In the inner space of the tubular vessel along its longitudinal geometrical axis, there is provided a rigid rectilinear pivot made as a perforated tubular core, whose ends are actually pipe unions enabling the communication of the tubular vessel with the pressure fluid medium source.

The ends of the tubular vessel are tightly secured in rigid holders, said pipe union being located in each of the holders.

Each holder is a bushing with a female thread engaging a pipe union male thread, so that the holders are rigidly coupled with each other by means of the rigid rectilinear pivot.

The known device for building up directional force accommodates a housing which comprises the tubular vessel and two cheeks located along the longitudinal geometrical axis of the housing coinciding with that of the tubular vessel.

The cheeks are puncheons designed for thrusting action on a rock mass or a structure to be demolished.

The puncheons are located diametrically opposite in relation to the longitudinal geometrical axis of the tubular vessel. Each puncheon adjoins the outside surface of the tubular vessel with the middle portion of its inside surface having two flat bevels diverging from this middle portion at an obtuse angle.

There is provided a device for pressing the puncheons against the tubular vessel, which is in fact a wide ring made of some elastic material and positioned in an annular recess in the middle portion of the puncheon.

The known device for building up directional force comprises wedge-shaped inserts located diametrically opposite in relation to the geometrical axis of the tubular vessel.

Each wedge-shaped insert has a surface, adjoining the outside surface of the tubular vessel out of contact with the puncheon, and two flat lateral surfaces positioned at an acute angle with each other, which adjoin the puncheon flat bevels.

The wedge-shaped inserts are designed to impart the force to the puncheons which is developed by the tubular vessel within the portions of its surface out of contact with the puncheons, as well as to make the tubular vessel within the same portions air-tight.

The known device could not find wide application because of the limited pressure built up by the fluid medium in the tubular vessel, which is generally not more than 100 MPa, and consequently owing to the limited directional force acting on borehole walls. This stems from the fact that the considerable axial loads, resulting from the pressure exerted by the fluid medium on the end portions of the regid rectilinear pivot and on those of the rigidly coupled holders, tension the rigid rectilinear pivot. A clearance is, therefore, formed between the holder and puncheon end portions facing each other. It is very difficult to make this clearance air-tight, in the event of a high pressure, say, over 100 MPa, the material of the tubular vessel "flowing" into it. To prevent the tubular vessel material from flowing into the clearance with the rigid rectilinear pivot under a high tensile stress, it is necessary to enhance the rigidity of the pivot without increasing its production cost, i.e. without replacing the material of the rigid rectilinear pivot with some other material which is of higher quality or not readily available.

A higher rigidity attained by increasing the diameter of the rigid rectilinear pivot is restricted by the dimensions of the inner space of the tubular vessel, which, in their turn, are determined by the thickness of the tubular vessel walls and by the cross-sectional dimensions of the known device for building up directional force.

Larger dimensions of the inner space of the tubular vessel with the same thickness of the tubular vessel walls and the same cross-sectional dimensions of the known device for building up directional force result in a smaller travel of the wedge-shaped inserts and puncheons.

An attempt to keep the puncheon travel unchanged by decreasing the thickness of the wedge-shaped inserts, measured in a plane square with the geometrical axis of the rigid rectilinear pivot results in a marked increase of contact force on the lateral surfaces of the wedge-shaped inserts, which adjoin the puncheon bevels. This causes the lateral surfaces of the wedge-shaped inserts to crumple, thus limiting the fluid medium pressure in the tubular vessel.

In addition, the rigid rectilinear pivot has a smaller cross-section as it comprises a longitudinal inner space and a perforated side wall, which is necessary since this pivot also serves to deliver the fluid medium into the inner space of the tubular vessel.

SUMMARY OF THE INVENTION

It is an object of the present invention to provide improvement in or relating to a device for building up directional force, wherein a rigid rectilinear pivot is of such a design and so positioned in relation to the components of this device that it makes it possible to enhance the rigidity of the pivot and at the same time to increase the puncheon travel, thereby building up a large directional force.

this object is accomplished due to the fact that in a device for building up directional force, comprises at least a single tubular vessel made of some elastic material and adapted for communicating with a pressure fluid medium source. The ends of said vessel are tightly secured in rigid holders interconnected by means of a rigid rectilinear pivot which is in contact with the tubular vessel. The device comprises at least two puncheons located diametrically opposite relative to the geometrical axis of the rigid rectilinear pivot, and each of said puncheons adjoining the outside surface of the tubular vessel with the middle portion of its inside surface have two flat bevels diverging thereform at an obtruse angle. The device also comprises wedge-shaped inserts located diametrically opposite in relation to the geometrical axis of the tubular vessel, and each of said inserts have a surface adjoining the outside surface of the tubular vessel which is out of contact with the puncheon and two flat lateral surfaces positioned at an acute angle to each other, one of which adjoins one of the flat bevels of the respective puncheon, and a means is provided for pressing the puncheons against the tubular vessel, in accordance with the invention. The rigid rectilinear pivot is so positioned between the tubular vessel that the tubular vessels are located symmetrically with respect to the geometrical axis of this pivot. The pivot has flat bevels adjoining the other flat lateral surfaces of the wedge-shaped inserts, and the pivot is in contact with the tubular vessels through the agency of the surfaces adjoining the outside surfaces of the tubular vessels. And, the puncheons are located relative to the geometrical axes of the tubular vessels diametrically opposite to the surfaces of the rigid rectilinear pivot which are in contact with the outside surfaces of the tubular vessels.

Such an embodiment of the device for building up directional force provides higher rigidity of the rectilinear pivot by increasing its cross-sectional area. This is possible owing to the location of the rigid rectilinear pivot between the tubular vessels, which allows to make full use of the cross-sectional area of the whole device for building up directional force unoccupied by the tubular vessels, puncheons, and wedge-shaped inserts and not to limit its cross-sectional area by the dimensions of the inner space of the tubular vessel.

In addition, with the rigid rectilinear pivot positioned between the tubular vessels, it is possible to make this pivot one-piece, thereby enhancing its rigidity.

Higher rigidity of the rectilinear pivot makes it possible to considerably increase fluid medium pressure in the tubular vessels and, consequently, to ensure greater force developed by the puncheons for building up directional force.

The presence of bevels on the lateral surface of the rigid rectilinear pivot makes it possible to considerably increase the puncheon travel. This is achieved due to the fact that with the rigid rectilinear pivot having the aforesaid configuration, the wedge-shaped inserts can move in the direction not square with that of the puncheon travel, but at a certain angle therewith, thereby ensuring larger puncheon travel.

This, in turn, has made it possible to greatly widen a field of application of the device for building up directional force and to essentially improve its performance characteristics.

For instance, in breaking off large rock monoliths it is necessary not only to provide a split between boreholes, but also to ensure that this split develops throughout the entire fracture plane inside the rock mass. The larger is the travel of the puncheons of the device for building up directional force, the larger is the area of the fracture plane which can be provided with one and the same depth of boreholes, wherein the herein-disclosed device for building up directional force is positioned.

It is advisable that there be a single pair of the tubular vessels and the rigid rectilinear pivot be made composite using a rectangular br attached to the rigid holders with its ends and positioned with its larger (in cross-section) side square with the plane wherein the geometrical axes of the tubular vessels lie, and two elements enveloping the bar positioned with provision for moving along the larger (in cross-section) sides of the bar and connected with the bar by means of an elastic element, the flat bevels of the rigid rectilinear pivot which adjoin the flat lateral surfaces of the wedge-shaped inserts being provided on said elements.

Such an embodiment of the rigid rectilinear pivot ensures that the wedge-shaped inserts thrust forward in the course of puncheon return to their initial position. This is most important in case the flat lateral surfaces of the wedge-shaped inserts are positioned at a small acute angle, which is required for building up considerable directional force. With such a small acute angle it is fairly difficult for the wedge-shaped inserts to return to their initial position with the puncheons in the back stroke because of the large frictional force between the lateral surfaces of the wedge-shaped inserts and the adjoining flat bevels of the puncheons.

It is also recommendable that at least a single indenter be provided in each of the elements enveloping the bar, said indenter being positioned on its outside surface in the symmetry plane passing between the tubular vessels.

The indenters make it possible to considerably decrease power expenditures and, in particular, to reduce the fluid medium pressure in destroying rock monoliths, say, in splitting a rock mass. This is achieved through developing tensile stress in the fracture plane with the aid of the force built up by the puncheons of the herein-disclosed device, as well as through providing at the same time an additional breaking force in the tensile stress zone concentrated locally in the place of indenter penetration.

The use of the indenters makes it possible to considerably improve the quality of the split surface since the indenters serve to "preset" the original fracture plane in the borehole profile and hence, the fracture plane, owing to the symmetrical arrangement of the indenters, lies strictly in the plane of the borehole axes.

In addition, the indenters enable more accurate determination of the parameters of the stressed state of the rock mass with the aid of the device for building up directional force since these parameters are found to be much less affected by the rock mass strength.

Thus, the device for building up directional force, in accordance with the present invention, ensures that considerable directional force is developed with the device being small in size and light-weight.

The herein-disclosed device for building up directional force has fairly wide applications and is easy in operation.

The foregoing and other advantages of the present invention will become more evident from the following disclosure of a specific exemplary embodiment thereof, which must be considered as an unlimiting example with reference to the accompanying drawings.

The device for building up directional force, in accordance with the present invention, designed, for instance, for thrusting action on the borehole walls in breaking rocks and in determining their stress and strain properties will be hereinafter referred to, for brevity, as the "claimed device".

The claimed device comprises four tubular vessels 1 (FIG. 1) made of some elastic material arranged in parallel.

PREFERRED EMBODIMENT OF THE INVENTION

The upper ends 2 (FIG. 1) of the tubular vessels 1 are put on pipe unions 3 and, in particular, on their heads 4 in the form of two truncated cones interconnected with each other by means of their larger bases.

The tubular vessels 1 are designed for communicating with a pressure fluid medium source (not shown) of any known design serving this purpose.

Figure 1:
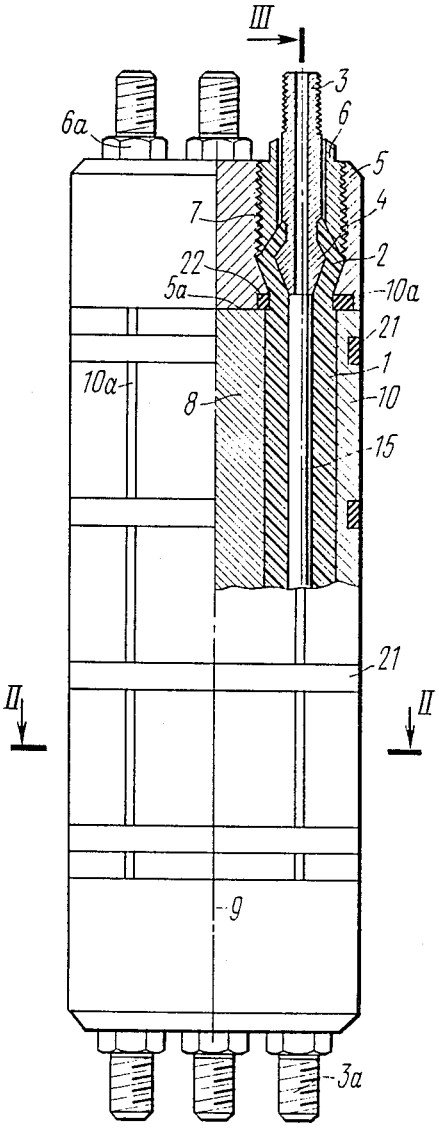
FIG. 1 is a general schematic view of a device for building up directional force, according to the present invention, showing a fragmentary longitudinal section superimposed on the general view.

The lower ends in FIG. 1 (not shown) of the tubular vessels 1 are likewise put on pipe unions 3*a* for letting out the air in the inner spaces of the tubular vessels 1 before these are filled in with the fluid medium prior to the beginning of the operating cycle. Provided in the pipe unions 3*a* are valves (not shown), shutting off the internal passage of the pipe unions 3*a* after the tubular vessels 1 are filled in with the fluid medium and being of any known design serving this purpose.

The ends 2 of the tubular vessels 1 are secured in two rigid holders 5 positioned in the end portions of the tubular vessels 1 by means of bushings 6 contained therein, the number of said bushings being equal to that of all the ends of the tubular vessels 1. The bushings 6 are provided with a thread 7 on their outside surface engaging the thread at the same Ref. No. 7 in the upper part (FIG. 1) of the inside surface of the holder 5. The lower part (FIG. 1) of the inside surface of the holder 5 is made smooth and taper in shape, narrowing downwards to hermetically tighten the end 2 of the respective tubular vessel 1 together with the head 4 of the pipe union 3. Provided together with the bushings 6 are nuts 6*a* to screw said bushings 6 into the holders 5.

The claimed device comprises a rigid rectilinear pivot 8 (FIGS. 1 and 2) rigidly interconnecting the holders 5 by welding the ends of the pivot 8 and the adjoining end portions 5*a* of the holders 5.

Figure 2:
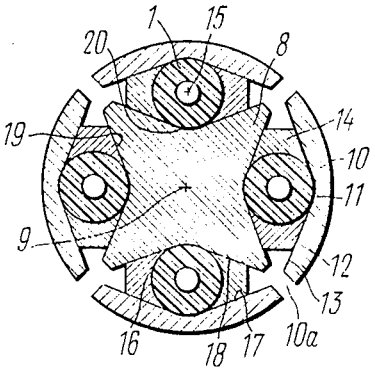
FIG. 2 is a section on line II—II in FIG. 1.

The pivot 8 is positioned between the tubular vessels 1 so that these vessels 1 are located diametrically opposite in relation to the geometrical axis 9 of this pivot 8, which runs parallel to the tubular vessels 1.

the claimed device comprises four puncheons 10 positioned diametrically opposite in relation to the axis 9 of the pivot 8, the puncheon cross section being in the form of a segment as is shown in FIG. 2, with a radius running from the centre located in the axis 9.

The puncheons 10 are spaced apart with an interval 10*a*, which is sufficient for their free radial reciprocating motion.

Each puncheon 10 adjoins the outside surface of the respective tubular vessel 1 with the middle portion 11 of its inside surface 12 having two flat bevels 13 diverging from the middle portion 11 at an obtuse angle.

The claimed device also comprises wedge-shaped inserts 14 (FIGS. 2 and 3) lacated diametrically opposite in relation to the geometrical axis 15 of each tubular vessel 1, whose cross-section, as is shown in FIG. 2, is trapezoidal in configuration.

Each wedge-shaped insert 14 (FIGS. 2 and 3) has a concave cylindrical surface 16 (FIG. 2) which is in fact its larger base and adjoins the outside surface of the respective tubular vessel 1 out of contact with the puncheon 10.

Each wedge-shaped insert 14 also has two flat lateral surfaces 17 and 18 positioned at an acute angle with each other, one of which, the surface 17, adjoins the respective flat bevel 13 of the respective puncheon 10 and the other, the surface 18, adjoins the pivot 8.

Provided on the pivot 8 lengthwise are flat bevels 19, the surfaces 18 of the wedge-shaped inserts 14 adjoining the bevels, and concave cylindrical surfaces 20 which adjoin the outside surfaces of the tubular vessels 1 and are conjugate to those. In relation to the geometrical axes 15 of the tubular vessels 1 the puncheons 10 are located diametrically opposite the surfaces 20 of the pivot 8 in contact with the outside surfaces of the tubular vessels 1.

There is provided a means 21 (FIGS. 1 and 3) for pressing the puncheons 10 against the tubular vessels 1, which is in fact four elastic rings at the same Ref. No. 21 evenly spaced along the length of the puncheons 10.

Provided in the end portions 5*a* (FIGS. 1 and 3) of the holders 5 on the side of the pivot 8 is an annular recess 22 shifted, as is shown in FIG. 1, from the geometrical axis 15 of the vessel 1 towards the outside surface of the holders 5. A packing at the same Ref. No. 22 is positioned in this recess 22 flush with the end portion 5*a* of the holders 5. The packing 22 is made of elastic material and serves to hermetically seal the joint of the end portion 5*a* of the holder 5 with the end portion 10*a* of the puncheon 10 and with the end portion 14*a* (FIG. 3) of the wedge-shaped inserts 14.

Figure 4:
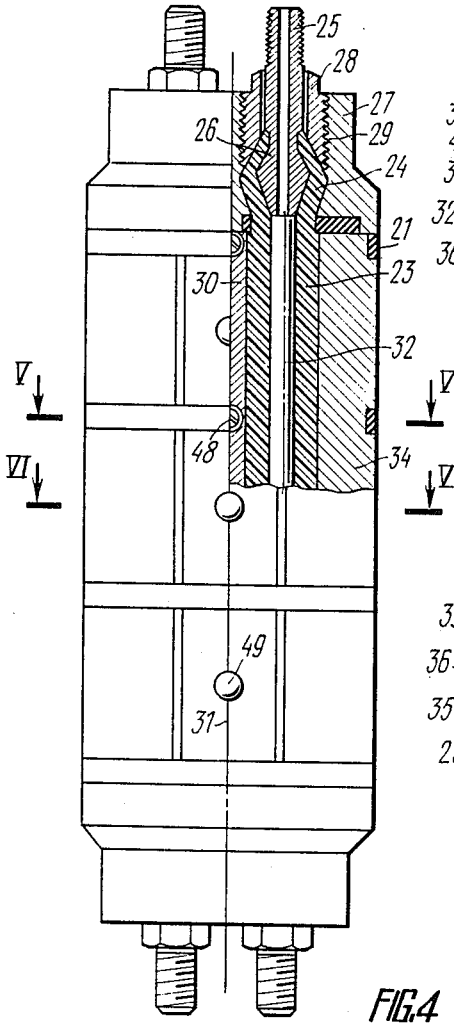
FIG. 4 is a general schematic view of a device for building up directional force, according to the present invention, in an embodiment, wherein there are two tubular vessels, two puncheons, and a composite pivot, showing a fragmentary longitudinal section superimposed on the general view.
Figure 5:
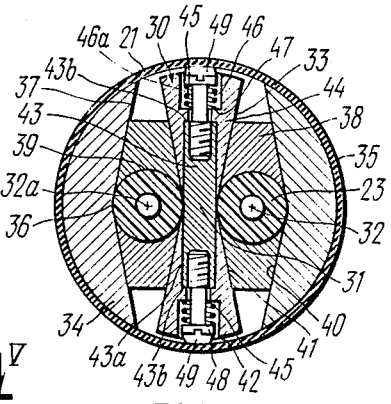
FIG. 5 is a section on line V—V in FIG. 4.
Figure 6:
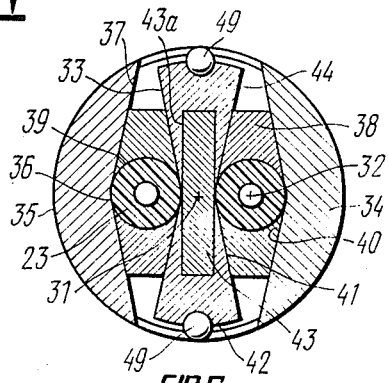
FIG. 6 is a section on line VI—VI in FIG. 4.

There may be another embodiment of the claimed device represented in FIGS. 4, 5, 6.

In this case the claimed device comprises two tubular vessels 23 made of some elastic material. The upper ends 24 (FIG. 4) of the tubular vessels 23 are similarly, as in the embodiment described hereinabove, put on pipe unions 25 and, in particular, on their heads 26 in the form of two truncated cones interconnected with each other by means of their large bases.

The tubular vessels 23 are intended for communicating with a pressure fluid medium source (not shown) of any known design through the agency of the pipe unions 25.

The lower ends in FIG. 4 (not shown) of the vessels 23 are likewise, as in the embodiment described hereinabove, put on the pipe unions 25*a* for letting the air out of the tubular vessels 23.

The ends of the tubular vessels 23 are secured in two rigid holders 27 by means of bushings 28 contained therein, the number of said bushings is equal to that of the ends of the tubular vessels 23. The bushings 28 are thread-joined 29 to the holders 27 and lock the ends of the tubular vessels 23 put on the heads 26 of the pipe unions 25 and 25*a* as described hereinabove.

There is provided a rigid rectangular pivot 30 (FIGS. 4, 5, 6) rigidly interconnecting the holders 27 likewise by welding the ends of the pivot 30 and the adjoining end portions of the holders 27.

The geometrical longitudinal axis 31 of the pivot 30 runs parallel to the geometrical axes 32 of the tubular vessels 23.

The pivot 30 comprises flat bevels 33 (FIGS. 5 and 6) arranged lengthwise so that the cross section of the pivot 30, as is shown in FIGS. 5, 6, is trapezoidal in configuration, said trapezoids being interconnected with each other by means of their smaller bases positioned in the plane passing through the geometrical axes 32 of the vessels 23, their height being square with this plane.

There are two puncheons 34 (FIGS. 4,5,6) positioned diametrically opposite in relation to the axis 31 of the pivot 30, their outside surface 35 (FIGS. 5 and 6) being in the form of a circular arc.

Each puncheon 34 adjoins the respective tubular vessel 23 with a middle cylindrical portion 36 of its inside surface. Provided in each puncheon 34 are two flat bevels 37 diverging from the middle portion 36 at an obtuse angle.

There are provided wedge-shaped inserts 38, two for each vessel 23, positioned diametrically opposite in relation to its axis 32. Each wedge-shaped insert 38 has a cylindrical surface, which is its larger base 39, adjoining the outside surface of the tubular vessel 23 out of contact with the puncheon 34, and two flat lateral surfaces 40 and 41 positioned at an acute angle with each other. The surfaces 40 adjoin the flat bevels 37 of the puncheons 34 whereas the surfaces 41 adjoin the flat bevels 33 of the pivot 30.

The cross section of the outside surface 42 of the pivot 30 is in the form of a circular arc with a diameter smaller than that of the outside surface 35 of the puncheons 34, which will be explained below.

In such an embodiment, the pivot 30 is made composite comprising a rectangular bar 43. The rigid connection of the pivot 30 with the holders 27 (FIG. 4) is ensured by welding the ends of the bar 43 to the holders 27.

The bar 43 is positioned with its larger (in cross section) side **43*a* (FIGS. 5 and 6) square with the plane in which the axes 32 of the vessels 23** lie.

The pivot 30 also accommodates two elements 44 enveloping the bar 43 positioned with provision for moving along the larger (in cross section) sides **43*a* of the bar 43**.

The enveloping elements 44 are connected with the bar 43 by means of elastic elements 45 (FIG. 5).

The bevels 33 (FIGS. 5 and 6) of the pivot 30 adjoining the flat lateral surfaces 41 of the wedge-shaped inserts 38 are provided on the enveloping elements 44.

Provided in the pivot 30 on the side of its outside surface 42 are pairs of holes 46 (FIG. 5) evenly spaced along the length of the pivot 30, said holes being positioned diametrically opposite in relation to the plane wherein the axes 32 of the vessels 23 lie and square with this plane.

Each hole 46 extends through the respective enveloping element 44 and through the smaller (in cross section) side **43*b* of the bar 43** adjoining it.

The hole 46 is made of different diameter along its length measured in the plane (FIG. 5), a portion **46*a* of the larger diameter being positioned in the enveloping element 44 not reaching the smaller (in cross section) side 43*b* of the bar 43, thereby forming an annular ledge 47 in the body of the enveloping element 44. The portion 46*b* of the smaller diameter extends from the ledge 47 and is provided with a thread (not indicated) in the body of the bar 43**.

Placed in the hole 46 is the elastic element 45, in this case a spring with a screw 48 thread-joined to the bar 43 positioned along its axis coinciding with that of the hole 46. The screw 48 serves to fix the elastic element 45, as well as to adjust and restrict the movement of each enveloping element 44.

Each enveloping element 44 carries three indenters 49 (FIGS. 4, 5, 6) evenly spaced along its length, said indenters being positioned on the line of intersection of the outer surface of the enveloping element 44 with the symmetry plane passing between the vessels 23 and square with the plane wherein the axes 32 of the vessels 23 lie.

The indenters 49 serve to concentrate part of the fluid medium pressure in the vessels 23 exerted via the wedge-shaped inserts 38 and the enveloping elements 44 to provide microdestruction on the borehole surface prestressed under the action of the puncheons 34 giving rise to major splits.

In this case the indenter 49 is of spherical shape and positioned partly in the body of the enveloping element 44 so that its external point (not indicated) most remote from the axis 31 of the pivot 30 is in the initial position within a distance from this axis 31 equal to the radius of the outside surface 35 of each puncheon 34.

Figure 3:
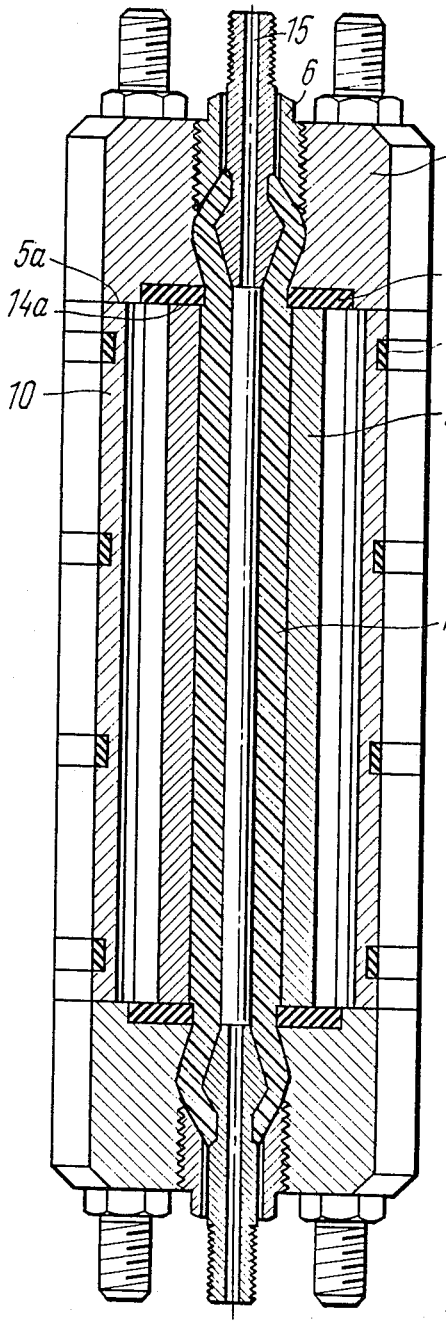
FIG. 3 is a section on line III—III in FIG. 1.

The device for building up directional force, according to the present invention, shown in FIGS. 1, 2, 3, operates as follows.

Prior to positioning the claimed device in the borehole (not shown) drilled in the solid rock mass, a main hose (not shown) is attached to each pipe union 3 to connect the inner space of the tubular vessel 1 with the pressure fluid medium source, a passage being opened in each pipe union **3*a*** by means of the valve.

With the fluid medium source in operation, the fluid medium comes under pressure to the inner spaces of the tubular vessels 1 and lets the air out via the valves of the pipe unions **3*a*. With the fluid medium passing through the pipe unions 3*a*, the pressure fluid medium source is disconnected and the passages of the pipe unions 3*a*** are shut off by means of the valves.

Subsequently, the claimed device is placed in the borehole so that its puncheons 10 are positioned in the preset direction, say, parallel to or square with the rock mass foliation in determining stress and strain properties of the rock mass in the said directions.

With the pressure fluid medium source in operation, the fluid medium comes to the inner spaces of the tubular vessels 1. While expanding under the action of the fluid medium, these vesselas 1 exert pressure both directly and through the wedge-shaped inserts 14 on the puncheons 10, thereby causing the puncheons 10 to move in the radial direction. Under the pressure exerted by the fluid medium in the inner space of the tubular vessels 1 on the end portions of the pipe unions 3, **3*a*, these move longitudinally as far as the resilience of the material of the tubular vessels 1 allows, thus ensuring that the ends 2, 2*a* of these vessels 1 are self-sealed. The higher is the pressure of the fluid medium in the inner space of the vessel 1, the more tightly are its ends 2, 2*a* pressed between the taper surfaces of the pipe union 3, 3*a* head and the respective inside surface of the bushing 6. This prevents a seal failure in the inner spaces of the vessel 1** in the event of a high, say, over 100 MPa fluid medium pressure.

The pressure of the fluid medium is imparted to the sealing packing 22 via the surface of the vessel 1 adjoining this packing 22, thus causing its elastic expansion in the direction of the geometrical axes 15 of the vessel 1. This makes it possible to compensate for the annular microclearance provided between the end portions of the puncheons 10 and the end portions **5*a* the holders 5 in the event of a high fluid medium pressure and prevent the material of the tubular vessels 1** from 37 flowing into the said microclearance.

Should the fluid medium pressure decrease in the inner space of the vessels 1, all the movable elements of the device for building up directional force return to their initial position under the influence of the device for pressing the puncheons 10.

The device for building up directional force, according to the present invention, in the embodiment shown in FIGS. 4, 5, 6 operates principally as the one described hereinavbove, the fluid medium pressure being exerted to the puncheons 34 and the pivot 30 via the vessels 23 and the wedge-shaped inserts 39. However, since the enveloping elements 44 are made with provision for moving radially, the fluid medium pressure is exerted to the borehole wall via the indenters 49 moving together with the enveloping elements 44, thereby causing an additional breaking force, which reduces power expenditures in splitting a rock mass.

A prototype of the device for building up directional force designed, according to the present invention, for boreholes 105 mm in diameter with four tubular vessels is 100 mm in diameter, 1 m long, the fluid medium pressure being 150 MPa, and develops a force of 4,000 tons, which makes it possible to effectively use said device for determining properties and a stressed state of rock masses featuring any strength.

A prototype of the other embodiment of the claimed device with indenters and two tubular vessels is 100 mm in diameter, 1 m long, the pressure being 150 MPa, and develops a force of 5,000 tons and can be effectively used in breaking off 1,000–2,000 $m^3$ monoliths along the line of boreholes 105 mm in diameter.

Industrial Applicability

The present invention can find most effective application in breaking off large rock monoliths along the borehole line and in destruction of foundations of old buildings and other structures.

The device for building up directional force, in accordance with the present invention, can also be used in boreholes for weakening a difficult-to-collapse roof in developing stratified deposits, for forced degassing of coalseams and studying a stressed and strained state of a rock mass under natural conditions.

The present invention can also find application in the engineering industry as a powerful small-size drive for actuating means of robots, presses, jacks, guillotine shears and other facilities calling for a great directional force to be developed.

I claim:

1. A device for building up directional force, comprising:

at least one tubular vessel (1) made of elastic material and adapted for communicating with a pressure fluid medium source, the ends (2) of each vessel being tightly secured in rigid holders (5) interconnected by means of a rigid rectilinear pivot (8) which is in contact with each tubular vessel (1);

at least two puncheons (10) located diametrically opposite with respect to the geometrical axis (9) of the rigid rectilinear pivot (8), each of said puncheons adjoining the outside surface of a tubular vessel (1) with the middle portion (11) of its inside surface (12) having two flat bevels (13) diverging therefrom at an obtuse angle, wedge-shaped inserts (14) located diametrically opposite relative to the geometrical axis (15) of each tubular vessel (1), each of said inserts having a surface (16) adjoining the outside surface of each tubular vessel (1) out of contact with each of said puncheons (10) and two flat lateral surfaces (17, 18) positioned at an acute angle to each other, one (17) of which adjoins one of the flat bevels (13) of a respective puncheon (10), and means (21) for pressing each of said puncheons (10) against a tubular vessel (1), wherein the rigid rectilinear pivot (8) is so positioned between the tubular vessels (1) so that the tubular vessels (1) are located symmetrically with respect to the geometrical axis (9) of said pivot (8), the pivot (8) having flat bevels (19) adjoining the other flat lateral surfaces (18) of the wedge-shaped inserts (14), whereas the pivot is in contact with the tubular vessels (1) through the agency of the surfaces (20) adjoining the outside surfaces of the tubular vessels (1), the puncheons (10) being located relative to the geometrical axes (15) of the tubular vessels (1) diametrically opposed to the surfaces (20) of the rigid rectilinear pivot (8) which are in contact with the outside surfaces of the tubular vessels (1).

2. A device as claimed in claim 1, comprising one pair of the tubular vessels (23) and wherein the rigid rectilinear pivot (30) is made as a composite of a rectangular bar (43) attached to rigid holders (27) with its ends positioned with its larger (in cross section) side (43*a*) square with the plane passing through the geometrical axes (32) of the tubular vessels (23), and two elements (44) enveloping the bar (43) and positioned with provision for moving along the larger (in cross section) sides (43*a*) of the bar (43) and connected with the bar (43) by means of an elastic element (45), the flat bevels (33) of the rigid rectilinear pivot (30) which adjoins the flat lateral surfaces (41) of the wedge-shaped inserts (38) being provided on said elements (44).

3. A device as claimed in claim 2, comprising at least one indenter (49) is secured in each of said elements (44) enveloping the bar (43), the indenter being positioned on its outside surface in the symmetry plane passing between the tubular vessels (23).

* * * * *